United States Patent [19]

Rothwell, Jr. et al.

[11] 4,390,811

[45] Jun. 28, 1983

[54] HIGH INTENSITY DISCHARGE LAMP INCLUDING ARC EXTINGUISHING MEANS

[75] Inventors: Harold L. Rothwell, Jr., Rowley; W. Calvin Gungle, Danvers, both of Mass.; Alan Daignault, Londonderry, N.H.

[73] Assignee: GTE Products Corporation, Stamford, Conn.

[21] Appl. No.: 244,433

[22] Filed: Mar. 16, 1981

[51] Int. Cl.[3] ..... H01J 7/44; H01J 17/34; H01J 19/78; H01J 29/96

[52] U.S. Cl. ..... 315/73; 315/74; 200/83 N

[58] Field of Search ..... 315/73, 74; 200/83 N, 200/150 D, DIG. 5

[56] References Cited

U.S. PATENT DOCUMENTS

| | | | |
|---|---|---|---|
| 3,845,260 | 10/1974 | Lohr | 200/83 N |
| 3,944,769 | 3/1976 | Wagner | 200/73 N |
| 4,039,893 | 8/1977 | Corbley | 315/73 |
| 4,143,301 | 3/1979 | Strauss et al. | 315/73 |
| 4,322,658 | 3/1982 | Minarczyk | 315/74 |

*Primary Examiner*—Saxfield Chatmon, Jr.
*Attorney, Agent, or Firm*—William H. McNeill

[57] ABSTRACT

A high intensity discharge lamp includes arc extinguishing means functional when the outer envelope of the lamp fails. The extinguishing means comprises a pressure sensing diaphragm and a terminal which will melt back when an arc is drawn therebetween. The extinguishing means operates within a time interval of several milli-seconds.

3 Claims, 8 Drawing Figures

HIGH INTENSITY DISCHARGE LAMP INCLUDING ARC EXTINGUISHING MEANS

TECHNICAL FIELD

This invention relates to high intensity discharge lamps of the type employing an arc tube within an outer envelope. Arc extinguishing means are included within the outer envelope of the lamp for interrupting power to the arc tube in the event of breakage of the outer envelope.

BACKGROUND ART

High intensity discharge (HID) lamps such as mercury vapor, metal halide and high pressure sodium lamps, because of their high luminous efficacy, excellent lumen maintenance, relative low cost of light, good optical efficiency and ease of installation have been in general use for many years and are in increasing demand today. It has recently been publicized that, under certain conditions, these HID lamps may present a potential health hazard.

The light emitting member of these lamps, namely, the quartz arc tube containing mercury vapor or metal halide, and the alumina high pressure sodium discharge tube, all contain mercury as at least one of the constituent fill components. The mercury vapor lamp arc tube uses only mercury as the fill component (except for argon starting gas) and the resulting lamp discharge yields the well known mercury high pressure line spectrum with infrared, visible and ultraviolet radiation. The metal halide tube uses mercury plus com-binations of various metal halide compounds as the fill components in addition to argon starting gas. The resulting spectrum will be characteristic of the metal introduced, augmented by the mercury line spectrum. The high pressure sodium lamp is filled with mercury and sodium in addition to starting gases of argon, xenon or neon or mixtures thereof. The spectrum of the discharge of this lamp is characteristic of high pressure sodium augmented by the line spectrum of mercury. Therefore, although ionized and excited mercury atoms are not the primary light producing species in metal halide and high pressure sodium arc tubes and lamps, sufficient mercury ionization and excitation occurs to produce visible and ultraviolet radiation of the characteristic mercury spectrum.

The characteristic mercury spectral lines produced by the discharges of the foregoing types of lamps produced ultraviolet radiation in the 200–297 nanometer range. Ultraviolet radiation in this range is potentially harmful. For example, conjunctivitis, an inflammation of the conjunctivae, will cause visual incapacitation and is caused by exposure to 250–297 nanometer radiation. Conjunctivitis when inflicted by exposure to the ultraviolet radiation is insidious as its symptoms do not appear until 2½ to 12 hours after exposure to such radiation. Numerous cases of ultraviolet radiation exposure causing abiotically produced cataracts of the eye lens have been reported. Even when such ultraviolet producing sources are viewed from considerable distances eye injuries can occur by ocular absorption.

Hermetically sealed outer glass envelopes are usually used to surround the light emitting tubes of HID lamps. This is done for three main reasons: (a) to obtain proper warm up and operating vapor pressures of the fill components by providing an inert gas or vacuum atmosphere between the discharge tube and the outer envelope, (b) to prevent the slow deterioration, due to oxidation, of the discharge tube lead-in wires and (c) to prevent the lamp from radiating the harmful ultraviolet energy produced by the inner tube.

With respect to point (c), the glass composition of the outer envelope is chosen so as to achieve absorption of the ultraviolet range causing known harmful effects. Therefore, when the outer glass envelope is intact, the harmful ultraviolet radiation emitted by the discharge tube is absorbed. When, for one reason or another, the glass envelope is broken the hermetically sealed light emitting discharge tubes of these lamps will continue to operate for tens to hundreds of hours and will now emit their harmful ultraviolet radiation to the surrounding areas thus creating a health hazard to persons in those areas. An increasing number of HID lamps are used indoors where lamps, if operating with broken outer envelopes, will be of particular danger because of the likelihood of lamp installations in close proximity to people.

Various solutions to this problem have been proposed by the prior art and these solutions can broadly be defined as: (1) means sensitive to an increase in oxygen in the outer envelope, (2) means sensitive to a change in pressure in the outer envelope, and (3) spring switch means held together by the actual configuration of the glass outer envelope.

Examples of proposed solutions under item (1) above included U.S. Pat. Nos. 3,262,012 and 4,208,614 wherein an oxidizable filament is employed in the outer envelope which will burn through in the event the outer envelope breaks and admits air.

An example of an item (2) pressure sensitive device can be found in U.S. Pat. No. 4,143,301 in which a bellows switch is used in conjunction with an oxidizable filament.

An item (3) contact switch is disclosed in U.S. Pat. No. 4,156,830.

While all of the above-described solutions will work to a greater or lesser degree, problems exist with all of them.

Time is a concern with the oxidizable filament approach; the above-cited U.S. Pat. No. 4,208,614 reciting a burn through time of 25 to 105 seconds.

The previously disclosed pressure sensitive devices are bulky and expensive and also employ, in conjunction therewith, an oxidizable filament.

The contact devices do not guaranty operation if the outer envelope is merely punctured at a spot remote from the switch.

DISCLOSURE OF INVENTION

It is, therefore, an object of this invention to obviate the disadvantages of the prior art.

It is another object of the invention to provide a simple, rugged, reliable and fast acting arc extinguishing device.

These objects are accomplished, in one aspect of the invention, by providing, for dual envelope high intensity discharge lamps, a lamp extinguishing means serially connected between a source of electrical power and one of the electrodes of the arc tube. The extinguishing means comprises an electrically conductive, evacuated, hermetically sealed diaphragm having a first effective dimension at a pressure near atmospheric pressure and a second effective dimension, larger than said first dimension, at pressures substantially less than atmospheric pressure. One side of the diaphragm is permanently electrically connected to one of the arc tube electrodes and the other side of the diaphragm is temporarily electrically connected to a terminal. The terminal is formed so that its effective length will shorten when it is subjected to an arc. Thus, in the event of breakage of the outer envelope, no matter how minute, the entrance of air into the envelope will increase the pressure therein. The increase in pressure will cause the diaphragm to contract, breaking positive electrical contact with the terminal. If the lamp is operating at this time an arc will be drawn between the diaphragm and the terminal of sufficient magnitude to cause the terminal to melt back, thus shortening its effective length until the distance between the terminal and diaphragm is too great for the current to jump, thereby extinguishing the lamp. The time for opening the circuit and shutting-off the lamp is of the order of several milli-seconds.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
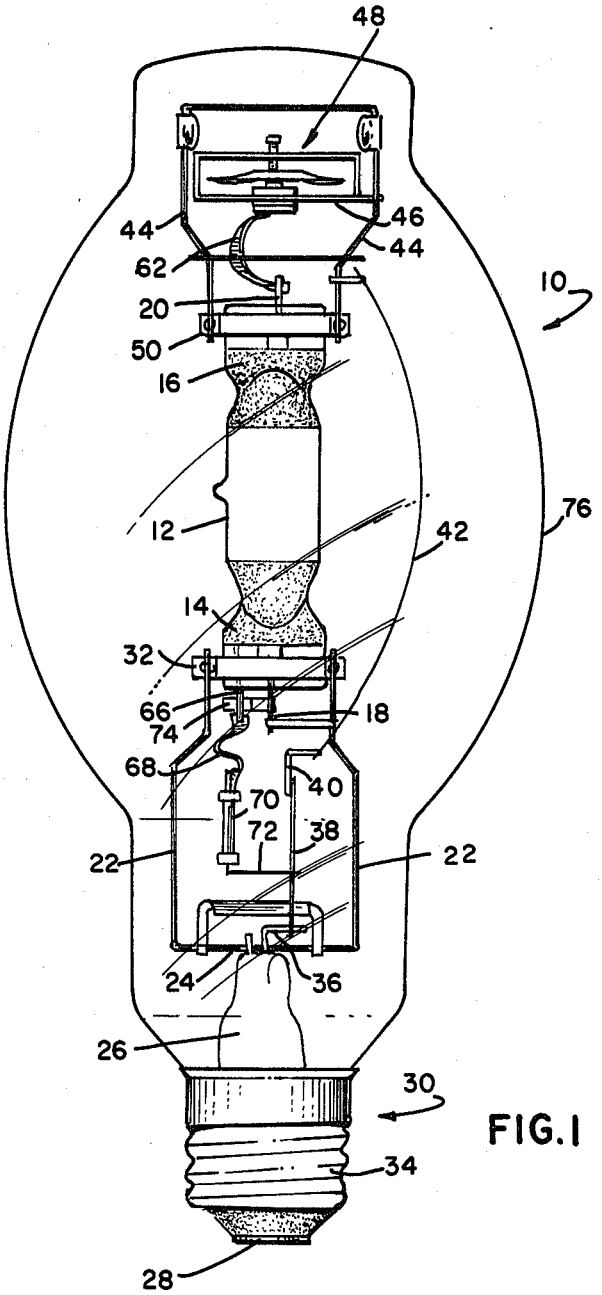
FIG. 1 is an elevational view of an HID lamp employing the invention.

Referring now to the drawings with greater particularity, there is shown in FIG. 1 a high intensity discharge lamp 10 having an arc discharge tube 12 of, for example, fused quartz. The ends 14, 16 of tube 12 are sealed around current carrying electrodes 18 and 20.

Electrode 18 is attached to metal frame 22 which is attached to metal lead-in 24 which is sealed into the glass press 26 and extends to the center conductor 28 of the base 30. The arc tube 12 is affixed to the frame 22 by metal retaining band 32.

The outside conductor 34, of base 30, is connected to metal lead-in 36, which also is sealed in glass press 26. Lead-in 36 is connected to electrode 20 by way of metal leads 38 and 40 and flexible connector 42. Connector 42 is attached to metal upper frame 44 which in turn is attached to a support 46 for the lamp extinguishing means 48. The upper frame 44 is attached to and supported by a retaining band 50 mounted on the end 16 of arc tube 12.

Figure 2:
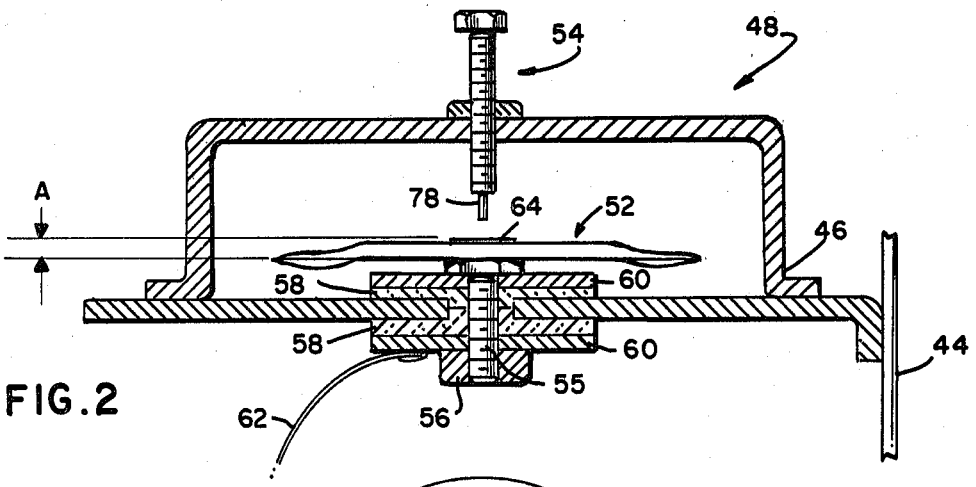
FIG. 2 is an enlarged, sectional, elevational view of the lamp extinguishing mechanism in an open-circuited condition.
Figure 6:
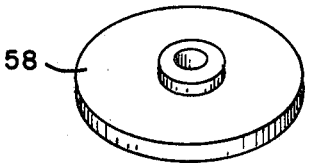
FIG. 6 is a perspective view of an insulating washer employed with the mechanism.

The lamp extinguishing means 48 (See FIGS. 2, 3 and 4) comprises an electrically conductive, evacuated, hermetically sealed diaphragm 52, preferably of stainless steel, and a terminal 54. One side of diaphragm 52 is permanently connected to, for example, electrode 20, by means of a threaded stud 55 which can be welded to diaphragm 52. The stud 55 passes through an aperture in support 46 and is electrically insulated therefrom by a pair of ceramic washers 58, one of which is shown in FIG. 6. Metal washers 60 can be placed adjacent the exposed surfaces of washers 58 to increase the strength thereof and, in the case of the lower metal washer 60, can provide the electrical contact for lead-wire 62 which provides the actual electrical path between the diaphragm 52 and electrode 20. Nut 56 engages the free end of stud 55 to hold the assembly to support 46.

The surface of diaphragm 52 opposite the surface carrying the stud 55 is provided with a terminal contacting area 64 which preferably is a thin disc of stainless steel, say 0.01" thick and 0.25" diameter, which has at least its upper surface gold plated.

The arc tube 12 can also be provided with an auxiliary electrode 66 which is connected to electrode 20 via a lead-wire 68, resistor 70, and lead-wire 72 which connects to lead-wire 38. A bimetallic switch 74, which is attached to electrode 18, electrically shorts auxiliary electrode 66 and electrode 18 after the arc has ignited, as is conventional.

Figure 3:
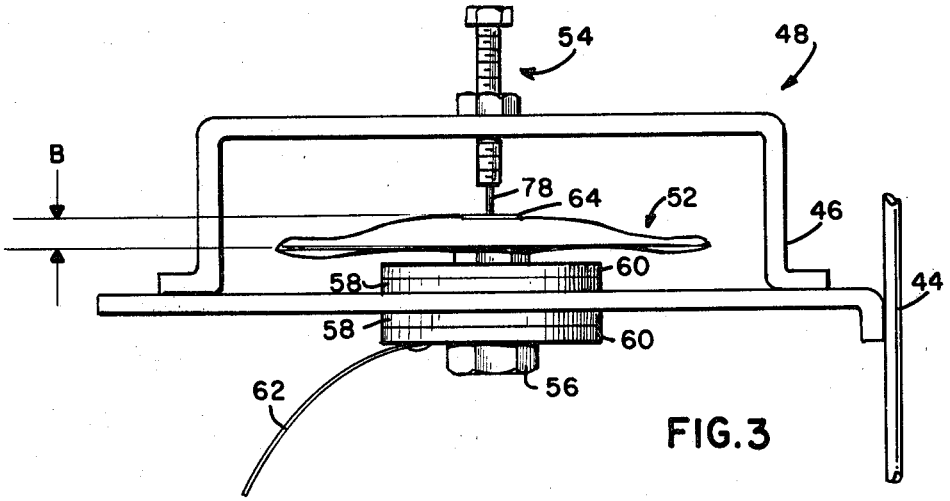
FIG. 3 is a view similar to FIG. 2 with the mechanism operational.
Figure 4:
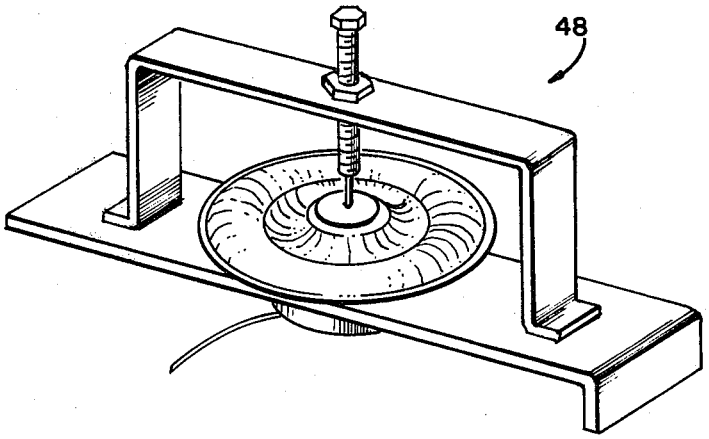
FIG. 4 is a perspective view of the mechanism.

Diaphragm 52, which has an internal pressure in the order of $10^{-6}$ torr, has a first effective dimension A (FIG. 2) when the pressure on its outer surface is near atmospheric, say 600 torr to 760 torr. When placed in an area of reduced pressure of the order of 100 torr, which is the pressure existing within outer envelope 76 when lamp 10 is completely asembled, the diaphragm 52 has a second effective dimension B, which is larger than A (FIG. 3). This increase in effective dimension allows disc 64 to contact end 78 of terminal 54 and establish electrical continuity for lamp 10.

Figure 7:
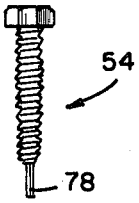
FIG. 7 is an elevational view of one form of terminal employed with the mechanism.

Terminal 54 (FIG. 7) is preferably a brass screw and has its end 78 formed with a reduced diameter of about 0.04" for approximately 0.125".

Figure 8:
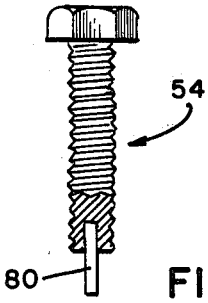
FIG. 8 is an elevational view of an alternate form of terminal, on an enlarged scale.

Alternatively, terminal 54 can be formed as in FIG. 8 wherein a longitudinal bore can be provided which is fitted with a material 80 which has a low melting point, such, for example, as a piece of wire solder.

During assembly of lamp 10 the mount, which is the arc tube 12 and its associated supporting structure, electrical lead-in, extinguishing means, etc., is inserted into outer envelope 76, which is then evacuated to a pressure of about 100 torr and sealed, as is conventional. At the time of insertion diaphragm 52 has the configuration shown in FIG. 2. After the evacuation of outer envelope 76, diaphragm 52 will have expanded to effective dimension B and will have the configuration of FIG. 3.

In a normally operating lamp the electrical current path follows from the outside conductor 34 of base 30, to metal lead-wires 36, 38, 40 and 42, to upper frame 44, support 46, terminal 54, diaphragm 52, lead-wire 62, and electrode 20, continuing through the arc discharge to electrode 18, frame 22, lead-wire 24 and finally to the center conductor 28 of base 30.

In the event of failure of the outer envelope 76 while the lamp is operating, it will be seen that the pressure therein will rapidly approach atmospheric. As this occurs, at a pressure of about 600 torr, diaphragm 52 collapses to its original effective dimension A, leaving a gap of about 0.006" between end 78 of terminal 54 and disc 64. A hot arc is thus initiated across this gap which will cause terminal 54 to melt back until the arc can no longer be sustained, thus extinguishing the lamp. The time needed to extinguish the lamp is of the order of a few milli-seconds.

If the lamp is not operating when outer envelope 76 fails, the gap of about 0.006" will be sufficient to keep the lamp from starting; however, even if the lamp should experience a power surge sufficient to initiate starting, the melt back of terminal 54 will quickly extinguish the lamp.

Figure 5:
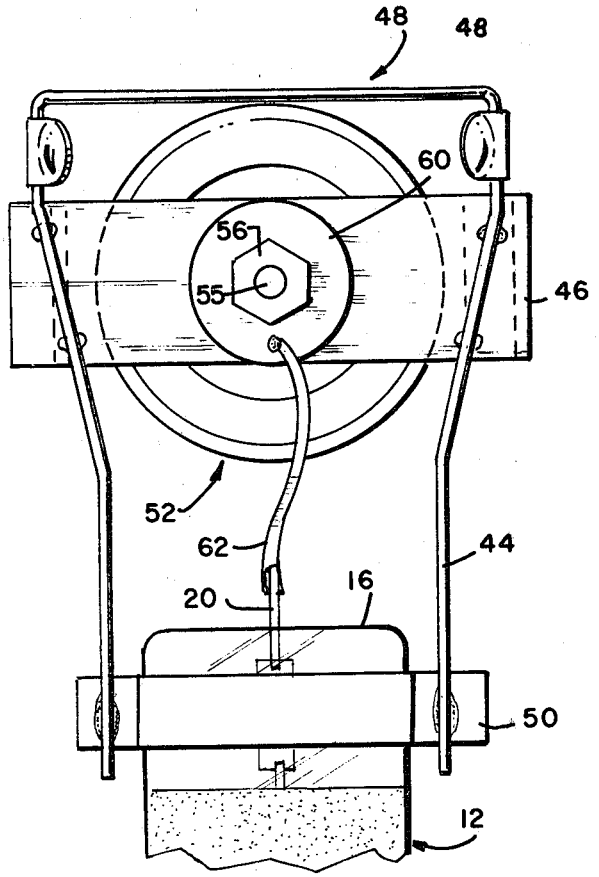
FIG. 5 is an elevational view of an alternate mode of mounting the mechanism.

The lamp extinguishing means 48 is a rugged structure that is also versitile in its mounting requirements. Thus, it can be mounted as shown in FIG. 1 with the axis of terminal 54 aligned with or parallel with the longitudinal axis of the lamp 10; or it can as easily be mounted with the axis of terminal 54 transverse to the lamp axis, as shown in FIG. 5.

While there have been shown and described what are at present considered to be the preferred embodiments of the invention, it will be apparent to those skilled in the art that various changes and modifications can be made herein without departing from the scope of the invention as defined by the appended claims.

What is claimed:

1. A high intensity discharge lamp having:

an inner arc tube having therein at least two electrodes between which a discharge takes place to produce visible light and ultraviolet radiation;

and an outer envelope substantially transparent to said visible light and opaque to said ultraviolet radiation, said outer envelope surrounding a volume having a pressure of the order of 100 torr;

a source of electrical power;

circuit means within said outer envelope electrically connecting said source of electrical power to said electrodes;

and lamp extinguishing means for interrupting said source of electrical power when the pressure in said outer envelope approaches atmospheric pressure, said lamp extinguishing means being serially connected between said source of electrical power and one of said electrodes and being characterized by an electrically conductive, evacuated, hermetically sealed diaphragm have a first effective dimension at pressures near atmospheric pressure and a second effective dimension, larger than said first effective dimension, at pressures substantially less than atmospheric pressure;

one side of said diaphragm being permanently electrically connected to one of said electrodes and the other side of said diaphragm being temporarily electrically connected to a terminal which will shorten its effective length by melting back when subjected to an arc; said diaphragm being disc-shaped and being evacuated to a pressure of about 10–6 torr.

2. The lamp of claim 1 wherein the end of said terminal in contact with said diaphragm has a reduced diameter.

3. The lamp of claim 1 wherein said terminal is substantially brass and the end of said terminal in contact with said diaphragm is formed from a material having a melting point lower than brass.

* * * * *